US011147128B2

(12) United States Patent
Qiu

(10) Patent No.: US 11,147,128 B2
(45) Date of Patent: Oct. 12, 2021

(54) ATOMIZER AND ELECTRONIC CIGARETTE

(71) Applicant: Joyetech Europe Holding GmbH, Zug (CH)

(72) Inventor: Weihua Qiu, Jiangsu (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 353 days.

(21) Appl. No.: 16/287,574

(22) Filed: Feb. 27, 2019

(65) Prior Publication Data

US 2019/0191769 A1 Jun. 27, 2019

Related U.S. Application Data

(63) Continuation-in-part of application No. PCT/CN2017/099270, filed on Aug. 28, 2017.

(30) Foreign Application Priority Data

Aug. 29, 2016 (CN) ..... 201610753838.7

(51) Int. Cl.

| | |
|---|---|
| ***H05B 3/44*** | (2006.01) |
| ***A24F 40/46*** | (2020.01) |
| ***A24F 40/485*** | (2020.01) |
| ***A24F 40/10*** | (2020.01) |

(52) U.S. Cl.

CPC ..... *H05B 3/44* (2013.01); *A24F 40/46* (2020.01); *A24F 40/485* (2020.01); *A24F 40/10* (2020.01)

(58) Field of Classification Search

CPC ..... A24F 40/485; A24F 40/46; A24F 40/10

See application file for complete search history.

(56) References Cited

U.S. PATENT DOCUMENTS 2,105,151 A * 1/1938 Kornblatt ..... A24F 1/16 131/339
2,704,081 A * 3/1955 Green ..... A24F 13/04 131/217

(Continued)

FOREIGN PATENT DOCUMENTS

| | | | |
|---|---|---|---|
| CN | 104244751 | A | 12/2014 |
| CN | 104921306 | A | 9/2015 |
| CN | 105411004 | A | 3/2016 |

(Continued)

*Primary Examiner* — Jean F Duverne

(74) *Attorney, Agent, or Firm* — Novick, Kim & Lee, PLLC; Allen Xue

(57) ABSTRACT

An atomizer includes an external sleeve and a heating assembly. The external sleeve defines an air intake hole. The heating assembly is received in the external sleeve. The heating assembly includes a tobacco holder and a heating member for heating the tobacco holder, the tobacco holder defines an atomizing chamber for filling fuming material, the tobacco holder defines a ventilation hole which fluidly communicates with the atomizing chamber. A spiral air intake passage is formed outside the tobacco holder and surrounds the tobacco holder, both the air intake hole and the ventilation hole fluidly communicate with the air intake passage, the tobacco holder and/or the heating member possesses a heating effect to the air intake passage. The tobacco holder and the air flow flowing through the spiral air intake passage can be heated at the same time.

12 Claims, 12 Drawing Sheets

(56) References Cited

U.S. PATENT DOCUMENTS

| | | | | |
|---|---|---|---|---|
| 2015/0086186 | A1 | 3/2015 | Boki | |
| 2018/0042299 | A1 * | 2/2018 | Han | A24F 40/30 |

FOREIGN PATENT DOCUMENTS

| | | | | |
|---|---|---|---|---|
| CN | 205233472 | U | | 5/2016 |
| CN | 105768234 | A | | 7/2016 |
| CN | 206005956 | U | | 3/2017 |
| WO | WO 2016119225 | | * | 4/2016 |
| WO | WO 2017/051150 | | * | 3/2017 |

* cited by examiner

ATOMIZER AND ELECTRONIC CIGARETTE

FIELD OF THE INVENTION

The invention relates to a technical field of smoking simulation, and more particularly, relates to an atomizer and an electronic cigarette.

BACKGROUND OF THE INVENTION

In the related flue-cured electronic cigarette, merely the fuming material such as tobacco material, tobacco strip or tobacco paste filled in the tobacco holder can be heated, the air flows into the tobacco holder cannot be pre-heated. The air outside the electronic cigarette has a temperature lower than the temperature in the tobacco holder. When the air flows into the tobacco holder via the air intake passage, it may reduce the temperate of the fuming material, resulting to an increase of the dissipation of the heat of the fuming material. An amount of the generated aerosol is decreased, a flavor is influenced and the user's experience is reduced.

SUMMARY OF THE INVENTION

Accordingly, it is necessary to provide an atomizer and an electronic cigarette which can heat a tobacco holder and an air intake passage at the same time, ensure an air flow flowing into the tobacco holder to be hot, reduce a dissipation of the heat of the fuming material in the tobacco holder, and improve a flavor.

The technical solution to solve the technical problem of the invention is as follow:

An atomizer includes an external sleeve and a heating assembly. The external sleeve defines an air intake hole. The heating assembly is received in the external sleeve. The heating assembly includes a tobacco holder and a heating member for heating the tobacco holder, the tobacco holder defines an atomizing chamber for filling fuming material, the tobacco holder defines a ventilation hole which fluidly communicates with the atomizing chamber. A spiral air intake passage is formed outside the tobacco holder and surrounds the tobacco holder, both the air intake hole and the ventilation hole fluidly communicate with the air intake passage, the tobacco holder and/or the heating member possesses a heating effect to the air intake passage.

Further, the tobacco holder is further provided with a helical flange on an external peripheral surface thereof, and a side of the helical flange away from the external peripheral surface of the tobacco holder resists an internal peripheral surface of the external sleeve, or the external sleeve is provided with a helical flange on an internal peripheral surface thereof, and a side of the helical flange away from the internal peripheral surface of the external sleeve resists the external peripheral surface of the tobacco holder, the air intake passage is constituted by a space which is formed by the helical flange, the internal peripheral surface of the external sleeve, and the external peripheral surface of the tobacco holder.

Further, the heating member is positioned on the external peripheral surface of the tobacco holder, or the heating member is positioned in a sidewall of the tobacco holder, or the heating member is positioned on the internal peripheral surface of the tobacco holder.

Further, the heating assembly further includes an internal sleeve sleeved on the tobacco holder, the internal sleeve is provided with a helical flange on an external peripheral surface thereof, and a side of the helical flange away from the external peripheral surface of the internal sleeve resists an internal peripheral surface of the external sleeve, or the external sleeve is provided with a helical flange on an internal peripheral surface thereof, and a side of the helical flange away from the internal peripheral surface of the external sleeve resists the external peripheral surface of the internal sleeve, the air intake passage is constituted by a space which is formed by the helical flange, the internal peripheral surface of the external sleeve, and the external peripheral surface of the internal sleeve.

Further, the heating member is clamped between the tobacco holder and the internal sleeve, or the heating member is positioned in a sidewall of the tobacco holder, or the heating member is positioned on the internal peripheral surface of the tobacco holder Further, the external sleeve forms a resisting portion at a lower end thereof shrinking inwardly, the resisting portion is provided at least one cutout, a lower end of the tobacco holder resists the resisting portion, the cutout fluidly communicates with the air intake passage and the ventilation hole respectively.

Further, the atomizer includes a base seat, positioned on a lower end of the external sleeve, the base seat forms at least two supporting portions at a bottom thereof, the at least two supporting portions extend upwardly, every two adjacent supporting portions forms a cutout there-between, a lower end of the tobacco holder resists the supporting portions, the cutout fluidly communicates with the air intake passage and the ventilation hole respectively.

Further, the external sleeve defines two latching grooves opposite to each other at a sidewall of a lower end of the external sleeve, the external peripheral surface of the base seat forms two latch members engaging the two latching grooves, the two latching member extend outwardly along a radial direction of the base seat, a connection between the base seat and the external sleeve is achieved by latching the latching members to the latching grooves.

Further, a lower end of the external peripheral surface of the internal sleeve defines an air intake cutout, the air intake passage extends to the lower end of the internal sleeve, and the air intake passage is then fluidly in communication with an internal chamber of the internal sleeve via the air intake cutout.

Further, the tobacco holder includes an atomizing tube and forms an end cover at an end of the atomizing tube, the end cover forms external threads at an external peripheral surface thereof, the external sleeve includes a tubular circumferential wall, the tubular circumferential wall forms an external peripheral flange extending outwardly at an upper end of the tubular circumferential wall, the external peripheral flange is adjacent to a terminal of the upper end of the tubular circumferential wall, an annular section is formed between the terminal of the upper end of the tubular circumferential wall and the external peripheral flange, the annular section defines at least one air intake hole at a circumferential wall of the annular section, an internal peripheral surface of the annular section forms internal threads engaging with the external threads on a periphery of the end cover.

Further, the atomizer further includes a base seat, wherein the external sleeve includes a tubular bottom wall formed on a lower end of the tubular circumferential wall, the tubular bottom wall is provided with a positioning tube at bottom surface thereof, the base seat includes a bottom plate, the bottom plate defines an aligning hole for the positioning tube to insert there-in when the external sleeve is assembled to the base seat.

Further, the heating member includes a tubular sleeve and a conductive pin connected to an end of the tubular sleeve, the tubular sleeve is sleeved on the atomizing tube, the conductive pin of the heating member extends out of the positioning tube.

Further, the tobacco holder is made of ceramic material.

Further, the atomizer further includes a heat shield which is sleeved on the external sleeve.

An electronic cigarette, includes any one of aforementioned atomizer.

Advantages of the invention are illustrated as follows: in the atomizer and the electronic cigarette of the invention, when working, the tobacco holder and the air flow flowing through the spiral air intake passage can be heated at the same time, the air flow can be pre-heated to ensure that the external air flow entering the tobacco holder is hot, the dissipation of the heat of the fuming material can be reduced, much more aerosol can be generated, a flavor can be improved, and the user's experience can be enhanced.

BRIEF DESCRIPTION OF THE DRAWINGS

The invention is fully illustrated with reference to the accompany drawings and embodiment.

Figure 1:
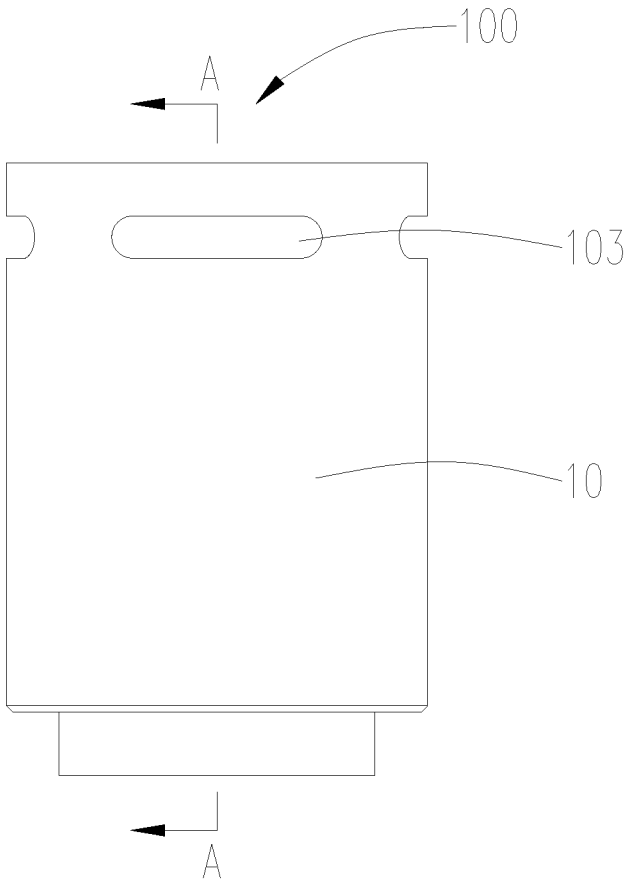
FIG. 1 is a schematic view of an atomizer of the first embodiment of the present disclosure.

The names and referral numbers of parts in the drawings are as follow:

| | | |
|---|---|---|
| atomizer 100, 200, 300 | external sleeve 10 | upper cover 20 |
| base seat 30 | heating assembly 40 | connector 50 |
| first sealing member 60 | second sealing member 70 | resisting portion 101 |
| cutout 102, 303 | latching groove 104 | bending portion 105 |
| latching member 301 | supporting portion 302 | tobacco holder 41 |
| atomizing chamber 411 | ventilation hole 412 | helical flange 413, 431 |
| air intake passage 414, 432 | heating member 42 | internal sleeve 43 |
| through hole 501 | air intake hole 103 | tobacco carrying board 415 |
| end cover 416 | tubular sleeve 421 | conductive pin 422 |
| limiting gasket 417 | atomizing tube 418 | air intake cutout 434 |
| tubular circumferential wall 106 | tubular bottom wall 107 | external peripheral flange 1061 |
| annular section 108 | positioning tube 1071 | bottom plate 304 |
| annular protrusion 305 | aligning hole 3041 | heat shield 80 |
| covering plate portion 21 | upper cover peripheral flange 22 | mouth piece connector 211 |

DETAILED DESCRIPTION OF THE PREFERRED EMBODIMENT

Embodiments of the invention are described more fully hereinafter with reference to the accompanying drawings. The accompany drawing are simplified schematic diagrams, which only illustrates the basic structure of the invention in a schematic manner, so it only shows the constructions related to the invention.

The First Embodiment

Referring to FIG. 1, the present disclosure discloses an electronic cigarette. The electronic cigarette includes an atomizer 100 and a power source mechanism (not shown). The atomizer 100 is configured to fill with fuming material, and heat the fuming material when the atomizer 100 is electrically driven by the power source mechanism, thereby causing the fuming material to generate aerosol to be inhaled by a user.

Figure 2:
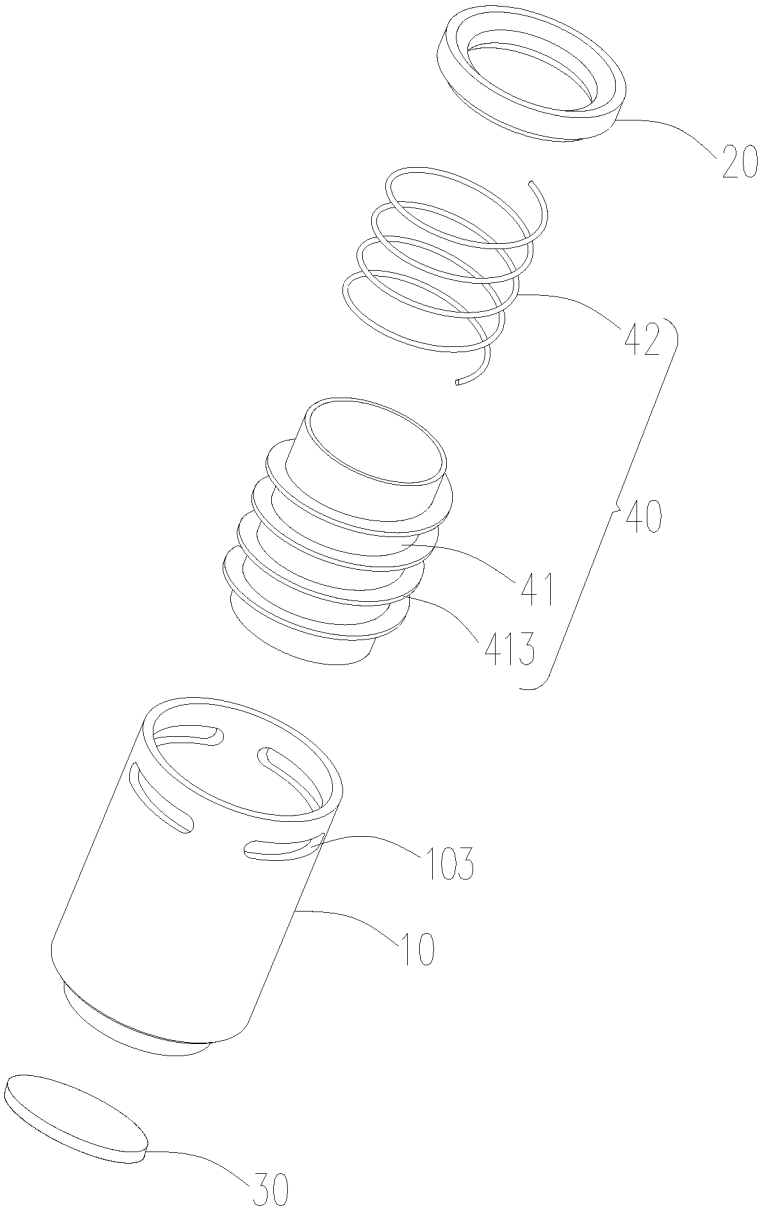
FIG. 2 is an exploded view of the atomizer of FIG. 1.
Figure 3:
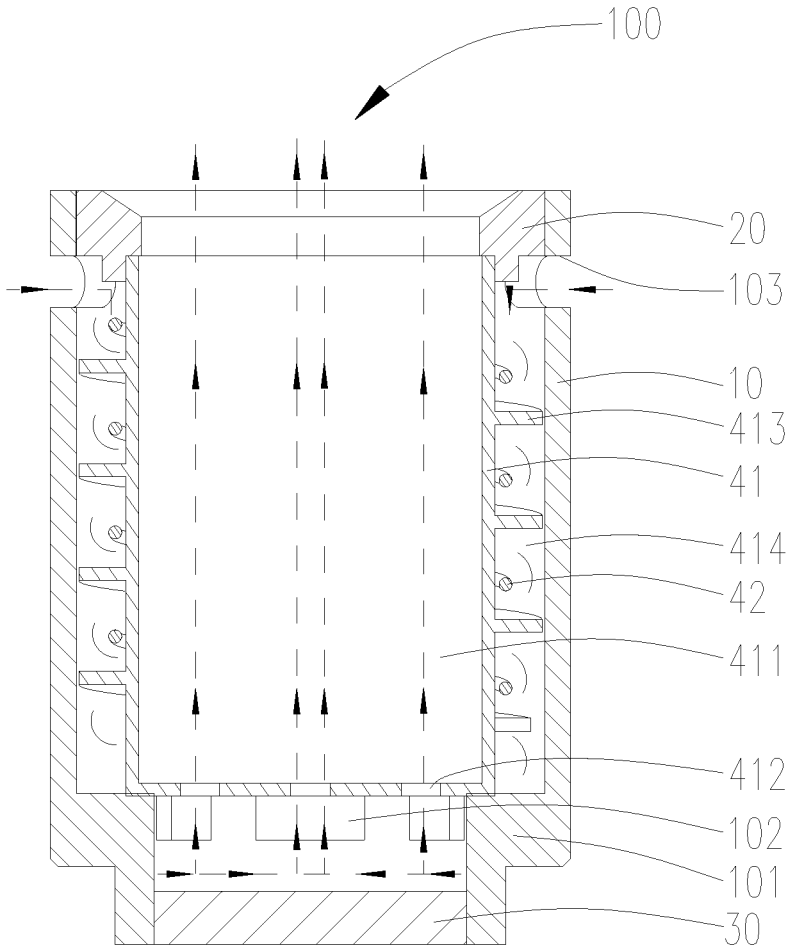
FIG. 3 is a cross-sectional view of the atomizer of FIG. 1, taken along line A-A.

Referring to FIG. 1, FIG. 2 and FIG. 3 at the same time, in the illustrated embodiment, the atomizer 100 includes an external sleeve 10, an upper cover 20 positioned on an end of the external sleeve 10, a base seat 30 positioned on an opposite end of the external sleeve 10, and a heating assembly 40 received in the external sleeve 10.

Referring to FIG. 2 and FIG. 3, the external sleeve 10 is substantially a hollow cylindrical structure having two openings at opposite ends of the external sleeve 10. The external sleeve 10 forms a resisting portion 101 at a lower end which shrinks inwardly. The resisting portion 101 is provided at least one cutout 102. The cutout 102 is fluidly in communication with an upper end of the resisting portion 101 and an internal peripheral surface of the resisting portion 101. The external sleeve 10 defines at least one air intake hole 103 on a sidewall of the upper end of the external sleeve 10, the at least one air intake hole 103 is fluidly in communication with an inner chamber of the external sleeve 10. In the illustrated embodiment, a number of the air intake hole 103 is four, the four air intake holes 103 are uniformly distributed.

Referring FIG. 2 and FIG. 3, the upper cover 20 is substantially an annular structure having two ends cutting through each other. The upper cover 20 is fixedly mounted on an upper end of the external sleeve 10, and is positioned above the air intake hole 103. In the illustrated embodiment, an external peripheral surface of the upper cover 20 engages the internal peripheral surface of the external sleeve 10 by an interference fit, thereby realizing a fixation between the upper cover 20 and the external sleeve 10. It can be understood that, in alternative embodiment not shown, the upper cover 20 and the external sleeve 10 can be fixed together by other modes such as a threaded connection, a latching connection, a plugging connection or a magnetic connection.

Referring to FIG. 2 and FIG. 3 at the same time, the base seat 30 is substantially a disc structure. The base seat 30 is fixedly connected to a lower end of the external sleeve 10 to seal an opening of the lower end of the external sleeve 10. In the illustrated embodiment, an external peripheral surface of the base seat 30 engages an internal peripheral surface of the external sleeve 10 by an interference fit, thereby realizing a fixation between the base seat 30 and the external sleeve 10. It can be understood that, in alternative embodiment not shown, the base seat 30 and the external sleeve 10 can be fixed together by other modes such as a threaded connection, a latching connection, a plugging connection or a magnetic connection.

Referring to FIG. 2 and FIG. 3 at the same time, in the illustrated embodiment, the heating assembly 40 includes a tobacco holder 41 and a heating member 42 sleeved on an periphery of the tobacco holder 41.

The tobacco holder 41 is substantially a hollow cylindrical structure having an opening at an upper end of the tobacco holder 41. The tobacco holder 41 is received in the external sleeve 10, a lower end of the tobacco holder 41 resists the resisting portion 101. An upper end of the tobacco holder 41 resists the upper cover 20, thereby fixing the tobacco holder 41 in the external sleeve 10. The tobacco holder 41 has an inner chamber configured to be an atomizing chamber 411 for filling fuming material. The tobacco holder 41 defines at least one ventilation hole 412 at the bottom of the tobacco holder 41. The ventilation hole 412 is fluidly in communication with the atomizing chamber 411 and the cutout 102, respectively.

Referring to FIG. 2 and FIG. 3 at the same time, the tobacco holder 41 is further provided with a helical flange 413, the helical flange 413 has a spiral shape and surrounds on an external peripheral surface of the tobacco holder 41. A side of the helical flange 413 is fixed to the external peripheral surface of the tobacco holder 41. A side of the helical flange 413 away from the external peripheral surface of the tobacco holder 41 resists the internal peripheral surface of the external sleeve 10. Therefore, an air intake passage 414 is constituted by a space which is formed by the helical flange 413, the internal peripheral surface of the external sleeve 10 and the external peripheral surface of the tobacco holder 41. The air intake passage 414 is fluidly in communication with the air intake hole 103 and cutout 102, respectively. In the illustrated embodiment, the helical flange 413 and the tobacco holder 41 are formed integrally. It can be understood that, in alternative embodiment not shown, the helical flange 413 can be connected to the tobacco holder 41 by welding. When user smokes, external air flows into the air intake passage 414 via the air intake hole 103, and enters into the atomizing chamber 411 via the cutout 102 and the ventilation hole 412 successively. The arrow shown in FIG. 3 indicates the air flow direction. The external air is configured to bring out the aerosol generated by the fuming material for user's swallow. In the illustrated embodiment, the external air is air. It can be understood that, in alternative embodiment not shown, the external air can be the gas harmless to the human body, such as the gas having fragrance, or a mixture of the air and the gas having fragrance. When the external air includes the gas having fragrance, the flavor of the aerosol can be increased, the user's experience can be further improved.

In the illustrated embodiment, the external sleeve 10, the upper cover 20, and the base seat 30 are made of heat insulation material, enabling the heat in the air intake passage 414 and the tobacco holder 41 difficult to be dissipated. The heat insulation material can be one of the mica, high-temperature resistant silicone gel, high-temperature resistant rubber, and PEK (polyether ketone).

It can be understood that, in alternative embodiment not shown, the helical flange 413 has a spiral shape and surrounds an internal peripheral surface of the external sleeve 10. A side of the helical flange 413 is fixed to the internal peripheral surface of the external sleeve 10. A side of the helical flange 413 away from the internal peripheral surface of the external sleeve 10 resists the external peripheral surface of the tobacco holder 41. Therefore, an air intake passage 414 having a spiral shape is constituted by a space which is formed by the helical flange 413, the internal peripheral surface of the external sleeve 10 and the external peripheral surface of the tobacco holder 41.

In the illustrated embodiment, the tobacco holder 41 is made of ceramic material. It can be understood that, in alternative embodiment not shown, the tobacco holder 41 can further be made of metallic material. When the tobacco holder 41 is made of metallic material, in order to the insulate the tobacco holder 41 from the heating member 42, an insulating layer can be provided on the external peripheral surface of the tobacco holder 41 and/or the external peripheral surface of the heating member 42.

In the illustrated embodiment, the heating member 42 is a spiral heating strip sleeved on a periphery of the tobacco holder 41. Each loop of the heating strip is embedded into a corresponding teeth groove of the helical flange 413, for achieving a sufficient heating of the tobacco holder 41. It can be understood that, in alternative embodiment not shown, the helical flange 413 can further define a mounting groove within the teeth groove, for enabling each loop of the heating strip to latch into the corresponding mounting groove, thereby avoiding an arbitrary slide of the heating strip. It can be understood that, in alternative embodiment not shown, the teeth groove of each helical flange 413 can be embedded by two or more than two loops of heating strip, for enhancing a heating efficiency.

When in use, the heating member 42 is electrically connected to the power source mechanism, under an electric driven of the power source mechanism, the heating member 42 is heated, and the heat is transferred to the tobacco holder 41, thereby the fuming material in the tobacco holder 41 generates aerosol under the heat function, the aerosol is brought by the air flow for user's swallow. Further, the heat of the tobacco holder 41 is transferred to the helical flange 413, the helical flange 413, the external peripheral surface of the tobacco holder 41 serve as a part of the air intake passage 414, all have a heating effect to the external air flowing through the air intake passage 414. The heating member 42 is positioned in the air intake passage 414, thus the heating member 42 can also have a heating effect to the external air flowing through the air intake passage 414. Because the air intake passage 414 is a spiral passage, thus the flowing distance of the external air is increased, the time period of the heating of the external air flowing through the air intake passage 414 is prolonged. At the same time, the contact area between the external air and the helical flange 413 is increased, the external air can be heated to a relative high temperature, and the temperature of the external air is approach to the temperature of the tobacco holder 41, thus a dissipation of the heat of the fuming material can be reduced, much more aerosol can be generated, a flavor can be improved.

It can be understood that, in alternative embodiment not shown, the heating member 42 can be a heating strip sintered in the ceramic tobacco holder, or can be a heating sheet adhered to the internal wall of the tobacco holder 41, merely the tobacco holder 41 can be heated by the heating member 42 under an electric driven of the power source mechanism, and the heating member 42 and/or the tobacco holder 41 can heat the air intake passage 414, which is not limited hereby.

In the atomizer 100 of the illustrated embodiment of the present disclosure, when it works, the tobacco holder 41 and the external air flowing through the spiral air intake passage 414 can be heated at the same time, the external air can be pre-heated to ensure that the external air entering the tobacco holder 41 is hot, the dissipation of the heat of the fuming material can be reduced, much more aerosol can be generated, a flavor can be improved, and the user's experience can be enhanced.

The electric cigarette provided by the present disclosure has all of the technical features of the aforementioned atomizer 100, thus the electric cigarette has a technical effect same as that of the aforementioned atomizer 100.

The Second Embodiment

Figure 4:
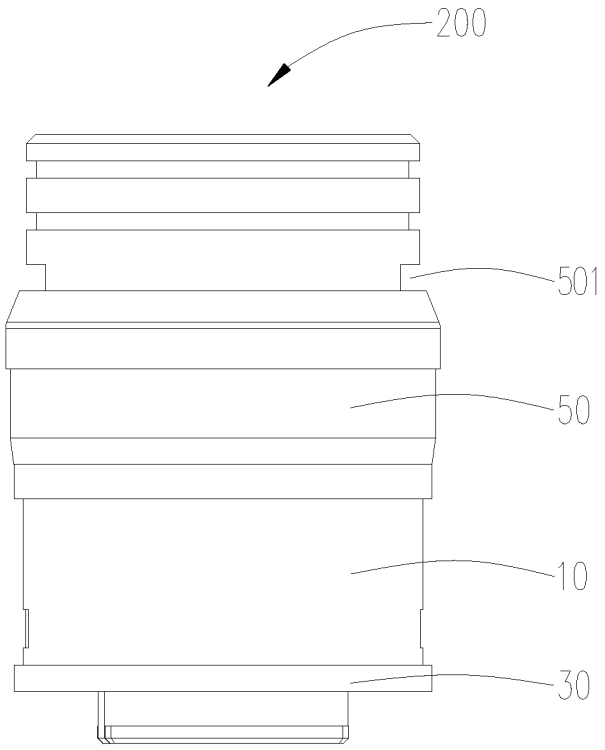
FIG. 4 is a schematic view of an atomizer of a second embodiment of the present disclosure.

Referring to FIG. 4, the second embodiment of the present disclosure discloses an electronic cigarette. The electronic cigarette includes an atomizer 200 and a power source mechanism (not shown). The atomizer 200 is configured to fill with fuming material, and heat the fuming material when atomizer 100 is electrically driven by the power source mechanism, causing the fuming material to generate aerosol for user's swallow.

Figure 5:
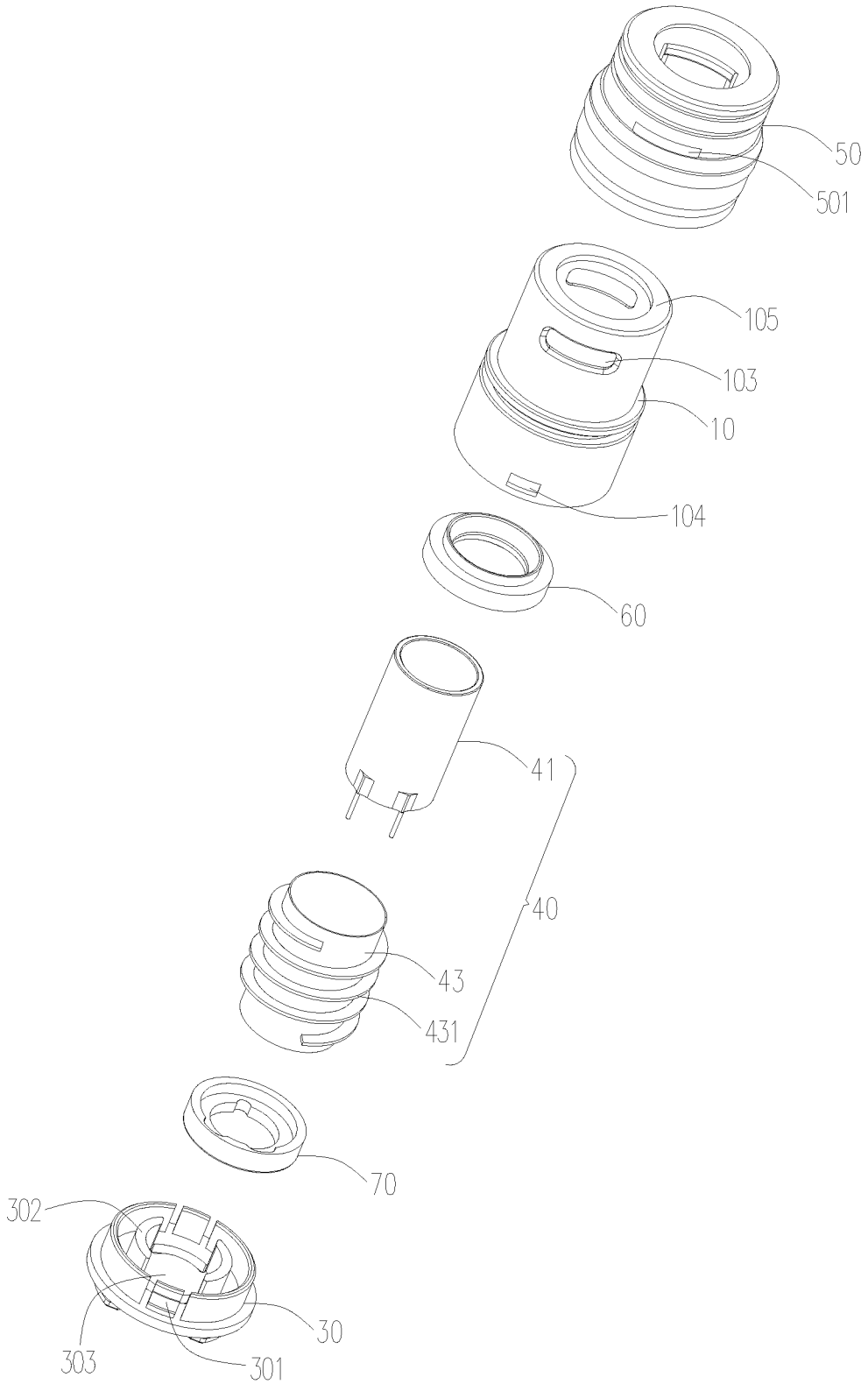
FIG. 5 is an exploded view of the atomizer of FIG. 4.
Figure 6:
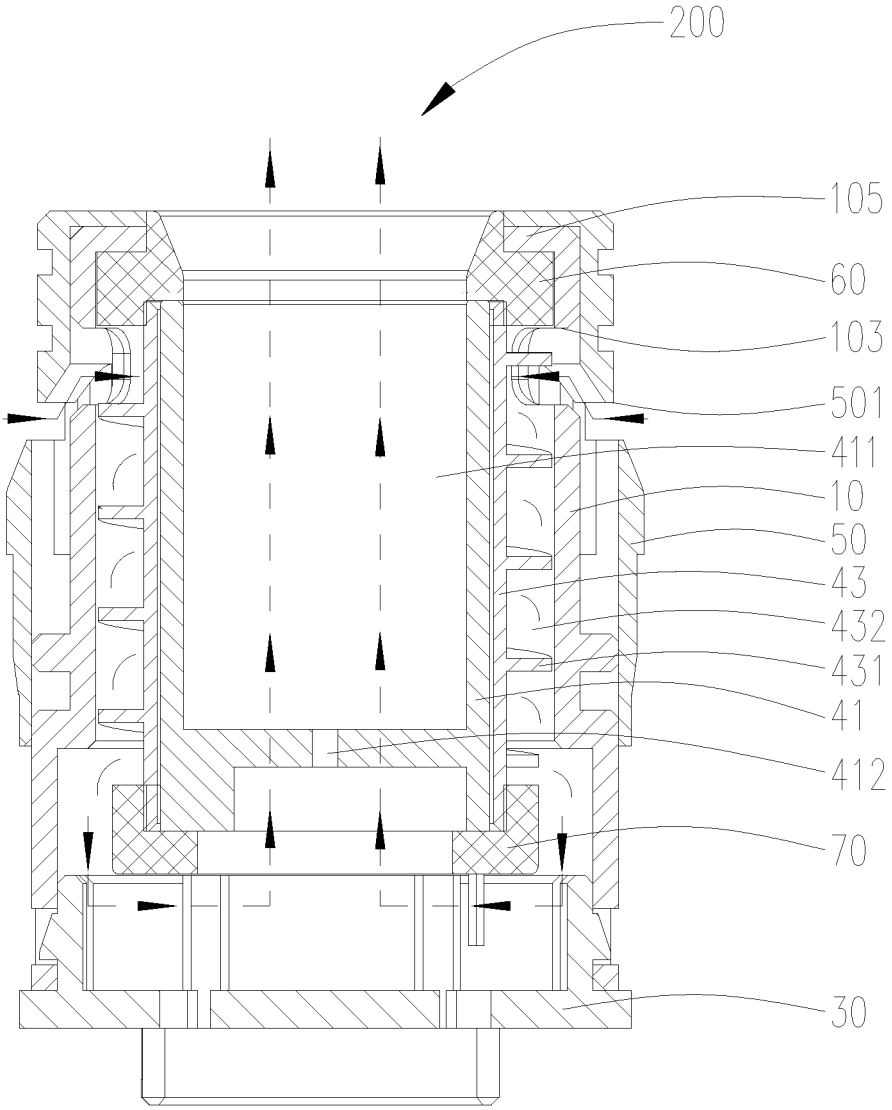
FIG. 6 is a cross-sectional view of the atomizer of FIG. 4.

Referring to FIG. 5 and FIG. 6 at the same time, in the illustrated embodiment, the atomizer 200 includes an external sleeve 10, a base seat 30 positioned on an end of the external sleeve 10, a heating assembly 40 received in the external sleeve 10, and a connector 50 sleeved on a periphery of the external sleeve 10.

Referring to FIG. 5, the external sleeve 10 is substantially a hollow cylindrical structure having two openings at opposite ends of the external sleeve 10. The external sleeve 10 defines two latching grooves 104 opposite to each other at a sidewall of a lower end of the external sleeve 10. The external sleeve 10 defines at least one air intake hole 103 on a sidewall of the upper end of the external sleeve 10, the at least one air intake hole 103 is fluidly in communication with an inner chamber of the external sleeve 10. In the illustrated embodiment, a number of the air intake holes 103 is two, the two air intake holes 103 are opposite to each other. The external sleeve 10 forms a bending portion 105 bending inwardly from an upper end of the external sleeve 10 along a radial direction of the external sleeve 10.

Referring to FIG. 5, the base seat 30 is substantially a hollow cylindrical structure having an opening at an upper end of the base seat 30. The external peripheral surface of the base seat 30 forms two latching members 301 engaging the two latching grooves 104. The latching member 301 extends along a radial direction of the base seat 30. A connection relationship between the base seat 30 and the external sleeve 10 is achieved by a latching between the latching members 301 and the latching grooves 104, thereby sealing the opening of the lower end of the external sleeve 10 by the base seat 30. It can be understood that, in alternative embodiment not shown, the base seat 30 and the external sleeve 10 can be connected by other modes such as a threaded connection, a latching connection, a plugging connection or a magnetic connection.

In the illustrated embodiment, the base seat 30 forms two supporting portions 302 opposite to each other at a lower end of the base seat 30. The two supporting portions 302 extend upwardly along an axial axis of the base seat 30. The supporting portion 302 is an arc-shaped plate structure, a gap between the two supporting portions 302 form a cutout 303. It can be understood that, in alternative embodiment not shown, a number of the supporting portions 302 is at least two. The cutout 303 is formed by the gap between each two adjacent supporting portions 302.

Referring to FIG. 5 and FIG. 6, the heating assembly 40 includes an internal sleeve 43 received in the external sleeve 10, a tobacco holder 41 received in the internal sleeve 43, and a heating member (not shown).

The internal sleeve 43 is substantially a hollow cylindrical structure having two openings at opposite ends of the internal sleeve 43. An upper end of the internal sleeve 43 resists the bending portion 105 of the external sleeve 10, the lower end of the internal sleeve 43 resists the supporting portions 302 of the base seat 30, thereby securing the internal sleeve 43 in the external sleeve 10. In order to improve a gas tightness and a connective stability, a first sealing member 60 is positioned between the internal sleeve 43 and the bending portion 105. A second sealing member 70 is positioned between the internal sleeve 43 and the supporting portion 302.

Referring to FIG. 5 and FIG. 6 at the same time, the internal sleeve 43 is further provided with a helical flange 431, the helical flange 431 has a spiral shape and surrounds a periphery of the internal sleeve 43. A side of the helical flange 431 is fixed to the external peripheral surface of the internal sleeve 43. A side of the helical flange 431 away from the external peripheral surface of the internal sleeve 43 resists the internal peripheral surface of the external sleeve 10. An air intake passage 432 having a spiral shape is constituted by a space which is formed by the helical flange 431, the internal peripheral surface of the external sleeve 10 and the external peripheral surface of the internal sleeve 43. The air intake passage 432 is fluidly in communication with the air intake hole 103 and the cutout 303, respectively. In the illustrated embodiment, the helical flange 431 and the internal sleeve 43 are formed integrally. It can be understood that, in alternative embodiments not shown, the helical flange 431 can be connected to the internal sleeve 43 by welding. It can be understood that, in alternative embodiments not shown, the helical flange 431 has a spiral shape and surrounds an internal peripheral surface of the external sleeve 10. A side of the helical flange 431 is fixed to the internal peripheral surface of the external sleeve 10. A side of the helical flange 431 away from the internal peripheral surface of the external sleeve 10 resists the external peripheral surface of the internal sleeve 43. An air intake passage 432 having a spiral shape is constituted by a space which is formed by the helical flange 431, the internal peripheral surface of the external sleeve 10 and the external peripheral surface of the internal sleeve 43.

In the illustrated embodiment, the tobacco holder 41 is substantially a hollow cylindrical structure having an opening at an upper end of the tobacco holder 41. The external peripheral surface of the tobacco holder 41 tightly contacts the internal peripheral surface of the internal sleeve 43. An upper end of the tobacco holder 41 resists the first sealing member 60, a lower end of the tobacco holder 41 resists the second sealing member 70, thereby securing the tobacco holder 41.

In the illustrated embodiment, the external sleeve 10, the first sealing member 60, and the second sealing member 70 are made of heat insulation material, causing the heat in the air intake passage 432 and the tobacco holder 41 difficult to be dissipated. The heat insulation material can be one of the mica, high temperature resistant silicone gel, high temperature resistant rubber, and PEK (polyether ketone).

An inner chamber of the tobacco holder 41 forms an atomizing chamber 411 for filling fuming material. The tobacco holder 41 defines at least one ventilation hole 412 at a bottom of the tobacco holder 41, the ventilation hole 412 is fluidly in communication with the atomizing chamber 411 and the cutout 303, respectively. In the illustrated embodiment, the tobacco holder 41 is made of ceramic materials.

In the illustrated embodiment, the heating member is a heating strip sintered in the tobacco holder 41, and the heating strip is electrically connected to the power source mechanism via a pin (not labeled) to enable the heating strip to generate heat, thereby heating the tobacco holder 41, causing the fuming material to generate aerosol. It can be understood that, in alternative embodiment not shown, the heating member further can be a heating sheet adhered to the inner wall of the tobacco holder 41, When user smokes, the external air flows into the air intake passage 432 via the air intake hole 103, and reaches the atomizing chamber 411 via the cutout 303 and the ventilation hole 412 successively. The arrow in FIG. 6 indicates the air flowing direction. The tobacco holder 41 is heated to generate heat by the heating member, the heat of the tobacco holder 41 is transferred to the internal sleeve 43, and is finally transferred to the helical flange 431. The external air flowing through the air intake passage 432 contacts the helical flange 431 and the external peripheral surface of the internal sleeve 43 and is heated, the heated external air enters into the atomizing chamber 411, a dissipation of the heat of the fuming material can be reduced, much more aerosol can be generated, a flavor can be improved.

The connector 50 is substantially a hollow cylindrical structure having two openings at opposite ends of the connector 50. The sidewall of the connector 50 defines a through hole 501 which is fluidly in communication with the air intake hole 103 correspondingly, facilitating for external air to enter into the electronic cigarette. In the illustrated embodiment, the connector 50 serves as a mounting carrier for mounting other components of the electronic cigarette. It can be understood that, in alternative embodiment not shown, the connector 50 can be omitted.

In the atomizer 200 of the second embodiment of the present disclosure, because the heating member is positioned in the tobacco holder 41, causing the tobacco holder 41 can be heated quickly, the external air flowing through the spiral air intake passage 432 can be heated at the same time, the external air can be pre-heated to ensure that the external air entering the tobacco holder 41 is hot, a dissipation of the heat of the fuming material can be reduced, much more aerosol can be generated, a flavor can be improved, and the user's experience can be improved.

The electric cigarette provided by the present disclosure has all of the technical features of the aforementioned atomizer 200, thus the electric cigarette has a technical effect same as that of the aforementioned atomizer 200.

The Third Embodiment

Figure 7:
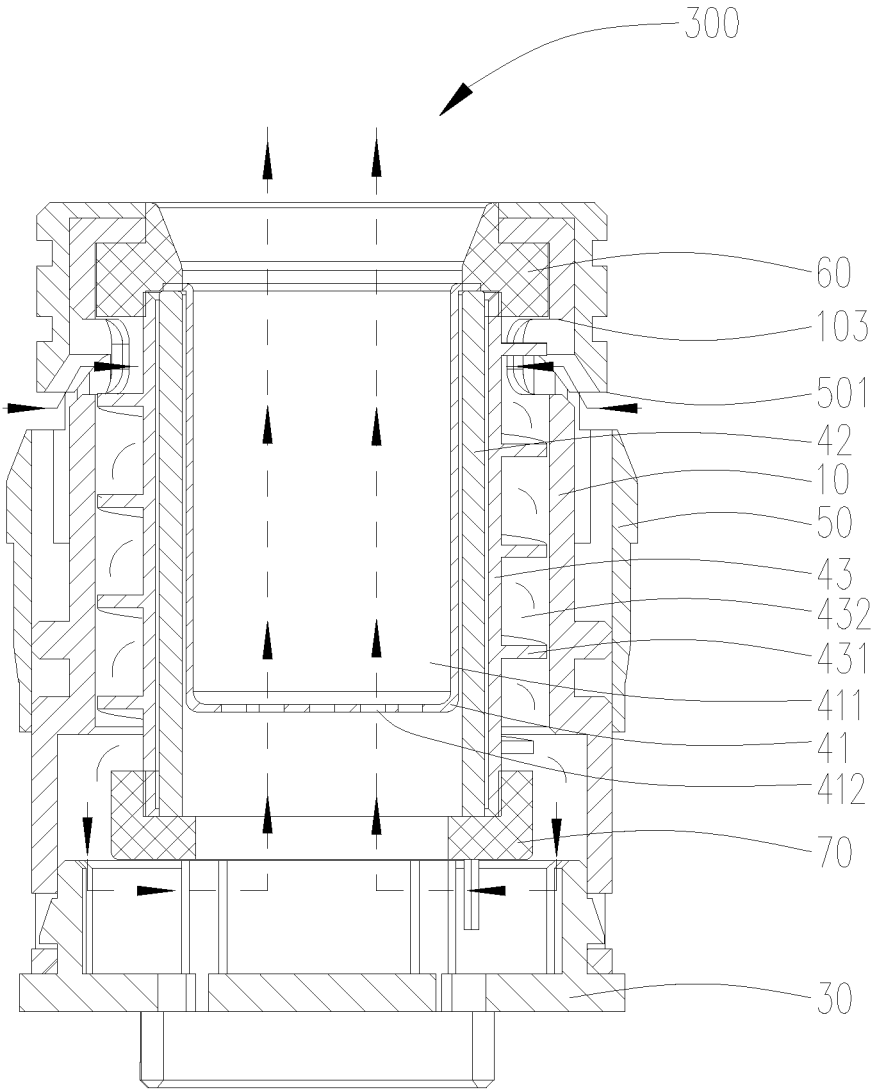
FIG. 7 is a cross-sectional view of an atomizer of a third embodiment of the present disclosure.

Referring to FIG. 7, the difference between the electronic cigarette provided by the third embodiment and the electronic cigarette provided by the second embodiment is that, the structure of the atomizer 300 of the electronic cigarette of the third embodiment is different. The specific detail is that the structure of the heating assembly 40 is different. The other structure is same as the structure of the electronic cigarette of the second embodiment, which is not specifically described hereby.

In the illustrated embodiment, the heating assembly 40 includes an internal sleeve 43, a tobacco holder 41 received in the internal sleeve 43, and a heating member 42 positioned between the internal sleeve 43 and the tobacco holder 41.

The structures of the internal sleeve 43 and the tobacco holder 41 is same as that in the second embodiment, which are not specifically described hereby.

The heating member 42 is substantially a hollow cylindrical structure having two openings at opposite ends of the heating member 42. The heating member 42 is electrically connected to the power source mechanism to realizing a heating for generating heat. The external peripheral surface of the heating member 42 closely contacts the internal peripheral surface of the internal sleeve 43, the internal peripheral surface of the heating member 42 closely contacts the external peripheral surface of the tobacco holder 41.

In the illustrated embodiment, because the heating member 42 is clamped between the internal sleeve 43 and the tobacco holder 41, when the heating member 42 works, the heat of the heating member 42 can be transferred to the internal sleeve 43 and the tobacco holder 41 at the same time, causing the internal sleeve 43 and the tobacco holder 41 to be heated at the same time, thus the external air flowing through the air intake passage 432 and the fuming material in the atomizing chamber 411 are heated at the same time, thereby, the external air flowing into the tobacco holder 41 can be pre-heated much more quickly. When use smokes, the air flowing direction is same as that in the second embodiment, referring to the indicated direction of the arrow in FIG. 7, which is not specifically described hereby.

In the illustrated embodiment, the heating member 42 is a heating jacket clamped between the internal sleeve 43 and the tobacco holder 41. It can be understood that, in alternative embodiment not shown, the heating member 42 can further be a heating strip or a heating sheet clamped between the internal sleeve 43 and the tobacco holder 41.

The electric cigarette provided by the present disclosure has all of the technical features of the aforementioned atomizer 300, thus the electric cigarette has a technical effect same as that of the aforementioned atomizer 300.

The Fourth Embodiment

Figure 8:
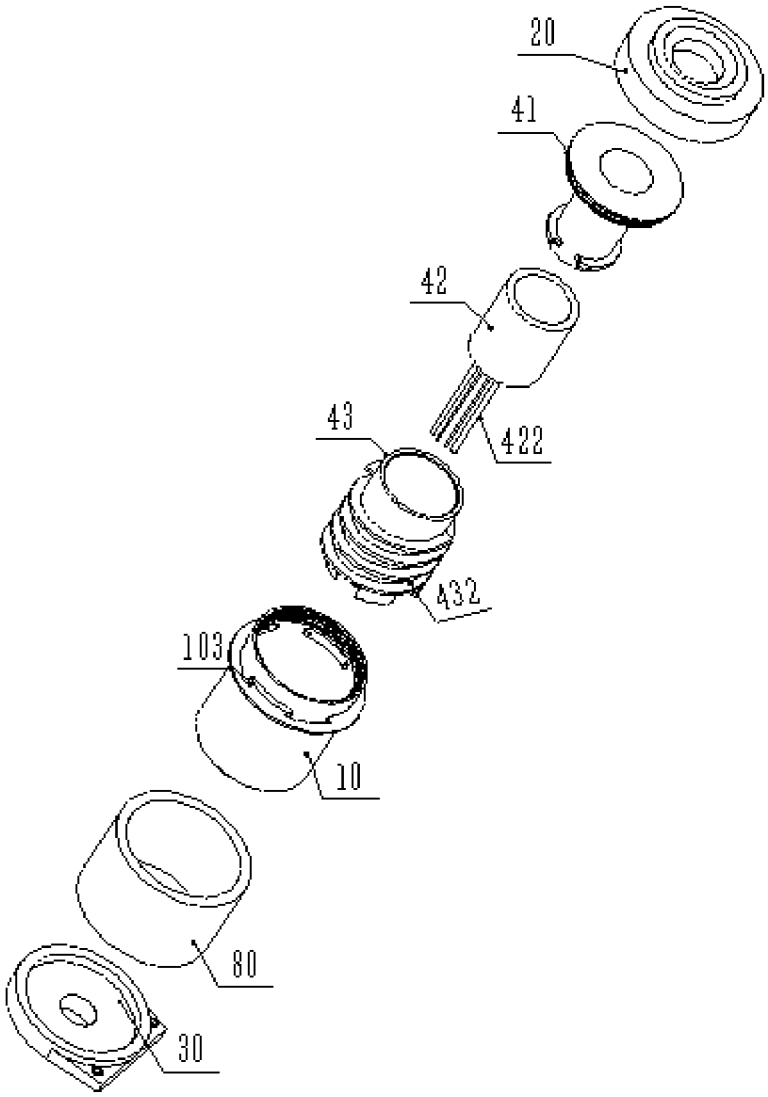
FIG. 8 is an exploded view of an atomizer of a fourth embodiment of the present disclosure.
Figure 9:
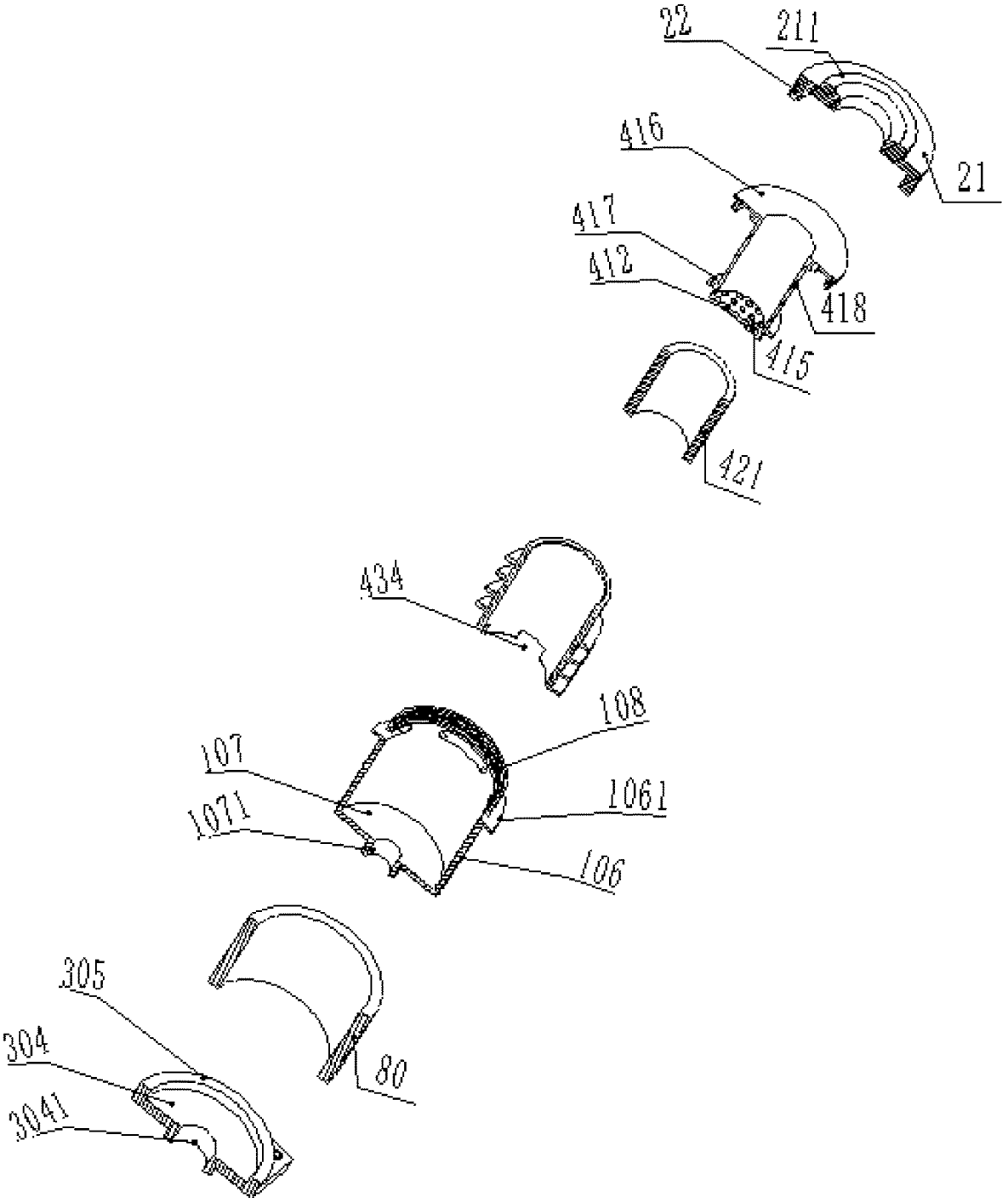
FIG. 9 is a cross-sectional view of the atomizer of FIG. 8.

Referring to FIG. 8 and FIG. 9, an atomizer provided by the present disclosure includes a tobacco holder 41, a heating member 42, an internal sleeve 43, an external sleeve 10, and a base seat 30. The tobacco holder 41 includes an atomizing tube 418, the atomizing tube 418 receives tobacco strip or tobacco paste. The heating member 42 is positioned outside the atomizing chamber, for roasting the tobacco strip or the tobacco paste in the atomizing tube 418. The internal sleeve 43 is sleeved on a periphery of the heating member 42, the base seat 30 is assembled to an end of the external sleeve 10, the internal sleeve 43 forms an intake channel, the intake channel is fluidly in communication with an end of the atomizing tube 418 which is positioned on an end of the base seat 30, causing the air can be heated by the heating member 42 when the air flows through the intake channel, and then the air flows into the atomizing tube 418. By a configuration of the atomizing tube 418 on the tobacco holder 41, the heating member 42 can be stably assembled, and the heating member 42 is isolated from the tobacco strip or the tobacco paste via the atomizing tube 418, a direct contact between the heating member 42 and the tobacco strip or between the heating member 42 and the tobacco paste can be avoided, thereby the tobacco strip or the tobacco paste cannot be burned in roasting or baking when using.

The tobacco holder 41 includes the atomizing tube 418, a tobacco carrying board 415 assembled in the atomizing tube 418, and an end cover 416 formed at an end of the atomizing tube 418. The tobacco carrying board 415 is configured to support the tobacco strip or the tobacco paste stored in the tubular chamber of the atomizing tube 418. The tobacco carrying board 415 defines a ventilation hole 412 for air flow to pass through. The tubular chamber of the atomizing tube 418 cuts through the end cover 416 integrally. The end cover 416 has an external diameter greater than that of the atomizing tube 418. The end cover 416 includes a board portion and a peripheral sidewall portion perpendicularly formed on a periphery of the board portion. A gap is provided between the peripheral sidewall portion and the external peripheral surface of the atomizing tube 418, the external peripheral surface of the peripheral sidewall portion forms external threads. Further, a resisting edge is formed in the gap between the peripheral sidewall portion and the external peripheral surface of the atomizing tube 418, the resisting edge is formed on the external peripheral surface of the atomizing tube 418, for limiting the heating member 42 when the heating member 42 is sleeved on the external peripheral surface of the atomizing tube 418.

In the illustrated embodiment, the heating member 42 has a tubular shape, and includes a tubular sleeve 421 and a conductive pin 422 connected to an end of the tubular sleeve 421, the tubular sleeve 421 is configured to be sleeved on the atomizing tube 418. After the tubular sleeve 421 is sleeved on the atomizing tube 418, the tubular sleeve 421 can be fixed by sleeving a limiting gasket 417 on the atomizing tube 418. The heating member 42 can be a heating strip by a selection, and is twined on the atomizing tube 418 in a spiral shape. The heating member 42 can also be a heating sheet forming a cylindrical shape by surrounding, and the heating sheet is sleeved on the atomizing tube 418. Or the heating member 42 is consisted by conductive material mixed with a heating sheet or mixed with a heating strip, and is positioned on a periphery of the atomizing tube 418. Preferably, the conductive material can adopt a PI(polyimide) heating membrane. Because the PI heating membrane has a high temperature resistance, and has an insulating function, and at the same time, due to the softness of the PI heating membrane, it can wind the heating strip and forms various shapes, enabling the flue-cured electronic cigarette to have a compact structure, and a volume is reduced.

A spirally distributed air intake passage 432 is formed on the periphery of the internal sleeve 43. The air intake passage 432 spirally extends from an upper end of the external peripheral surface of the internal sleeve 43 to the lower end of the external peripheral surface of the internal sleeve 43. Further, the lower end of the external peripheral surface of the internal sleeve 43 defines an air intake cutout 434, enabling the air intake passage 432 to extend to the lower end of the internal sleeve 43, and then the air intake passage 432 is fluidly in communication with the internal sleeve 43 via the air intake cutout 434.

The external sleeve 10 includes a tubular circumferential wall 106 and a tubular bottom wall 107 which is integrally formed on the lower end of the tubular circumferential wall 106, for blocking an end of the tubular circumferential wall 106. The tubular circumferential wall 106 has a radial diameter equal to an external diameter of the internal sleeve 43. The tubular circumferential wall 106 forms an external peripheral flange 1061 extending outwardly at an upper end of the tubular circumferential wall 106. The external peripheral flange 1061 is adjacent to the terminal of the tubular circumferential wall 106. Accordingly, an annular section 108 is formed between the terminal of the upper end of the tubular circumferential wall 106 and the external peripheral flange 1061. The annular section 108 defines a plurality of air intake holes 103 on the circumferential wall of the annular section 108. The plurality of air intake holes 103 are defined along a circumferential direction of the annular section 108. The air intake hole 103 has an arced shape. The internal peripheral surface of the annular section 108 forms internal threads, for engaging the external threads on the periphery of the end cover 416. The lower surface of the tubular bottom wall 107 forms a positioning tube 1071 integrally, and the tubular chamber of the positioning tube 1071 cuts through the tubular bottom wall 107. The positioning tube 1071 is configured for extending by the conductive pin 422 of the heating member 42, and the positioning tube 1071 is configured to be aligned to and fixed to the base seat 30 when the external sleeve 10 is assembled to the base seat 30.

After the internal sleeve 43 is sleeved within the external sleeve 10, the external surface of the air intake passage 432 of the internal sleeve 43 contacts the internal surface of the external sleeve 10, and the air intake passage 432 is surrounded to form an intake channel, the lower end of the internal sleeve 43 resists the tubular bottom wall 107, the upper end surface of the internal sleeve 43 is substantially aligned to the upper end surface of the annular section 108 of the external sleeve 10.

The base seat 30 includes a bottom plate 304 and an annular protrusion 305 formed on the bottom plate 304, the annular protrusion 305 surrounds the bottom plate 304 to form a sleeve space correspondingly, for sleeving an end of the external sleeve 10 correspondingly. The bottom plate 304 defines an aligning hole 3041 for the positioning tube 1071 to insert in when the external sleeve 10 is assembled to the base seat 30. The sleeve space surrounded by the annular protrusion 305 has a diameter equal to an external diameter of the external sleeve 10, causing the end of the external sleeve 10 to be stably assembled in the base seat 30.

The atomizer further includes a heat shield 80, for sleeving on a periphery of the external sleeve 10, causing the periphery of the heat-cured electronic cigarette to be effectively isolated from the heat source. The temperature of the periphery is not too high to lead to an inconvenient use. In the illustrated embodiment, the heat shield 80 has a thickness equal to a thickness of the annular protrusion 305, the internal diameter of heat shield 80 is equal to an external diameter of the external sleeve 10. When the heat shield 80 is sleeved on the external sleeve 10, an end of the heat shield 80 resists the external peripheral flange 1061 of the external sleeve 10, an opposite end of the heat shield 80 resists the annular protrusion 305.

The atomizer further includes an upper cover 20, the upper cover 20 is configured to cover an end of the tobacco holder 41 which has the end cover 416, for a mouth piece (not shown) to connect. The upper cover 20 includes a covering plate portion 21 and an upper cover peripheral flange 22 formed on a periphery of the bottom of the covering plate portion 21. The covering plate portion 21 forms a mouth piece connector 211 on an upper surface, the mouth piece connector 211 cuts through the covering plate portion 21. The mouth piece connector 211 is configured to connect with a mouth piece. The upper cover peripheral flange 22 has a thickness equal to a thickness of the heat shield 80, the internal diameter of the upper cover peripheral flange 22 is equal to an external diameter of the external sleeve 10.

Figure 10:
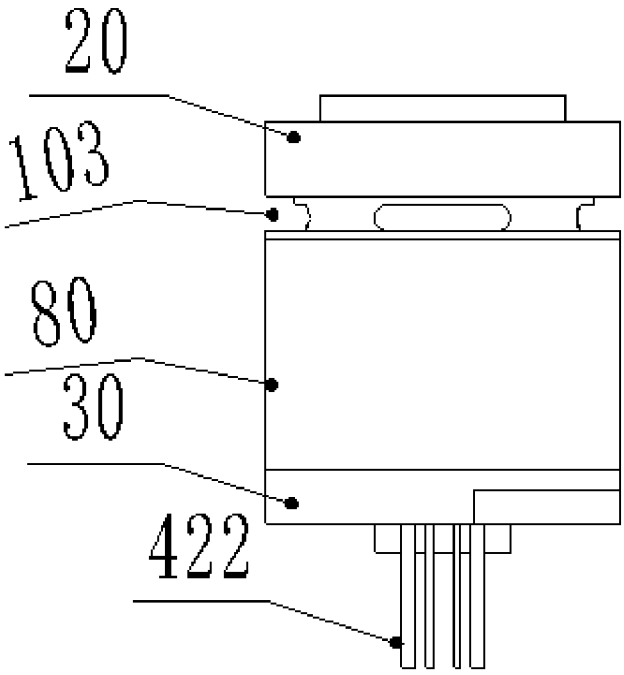
FIG. 10 is a front view of the atomizer of FIG. 8, after being assembled.
Figure 11:
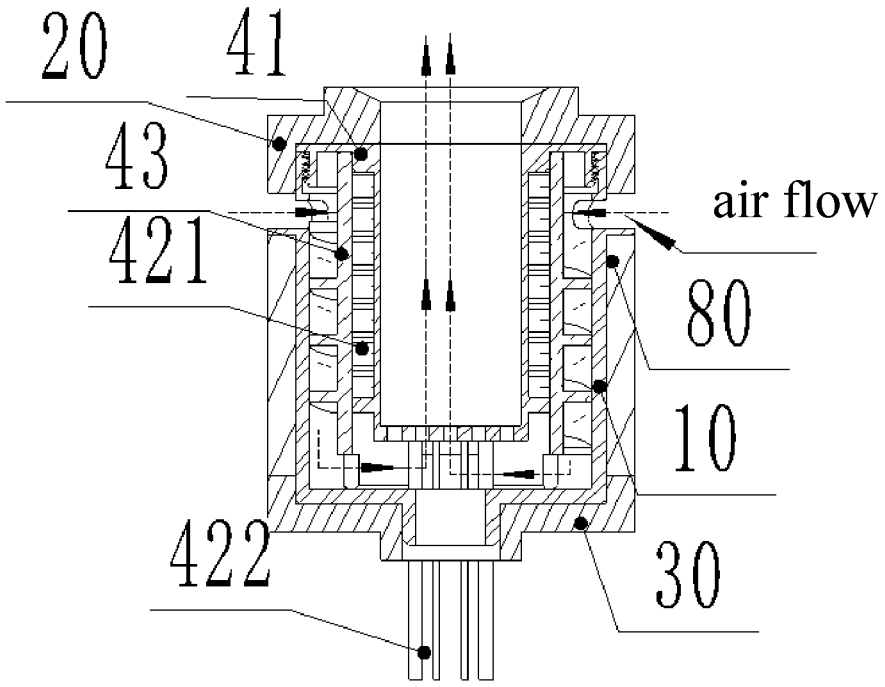
FIG. 11 is an isometric sectional view of the atomizer of FIG. 10.
Figure 12:
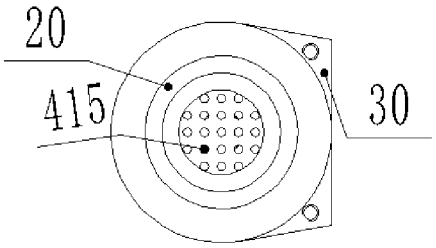
FIG. 12 is a top view of the atomizer of FIG. 10.

Referring to FIG. 10 and FIG. 12, when the atomizer is assembled, the heating member 42 is assembled to the external peripheral surface of the tobacco holder 41, and then the internal sleeve 43 is mounted on the external peripheral surface of the heating member 42. Then, the external sleeve 10 is sleeved on a periphery of the internal sleeve 43, the internal threads on the upper end of the external sleeve 10 are threaded connected to the external threads of the tobacco holder 41. The upper end of the external sleeve 10 is received in the gap between the peripheral sidewall portion of the tobacco holder and the external peripheral surface of the atomizing tube 418. After the upper cover 20 covers the upper end of the tobacco holder 41, and then the heat shield 80 is mounted on an external surface of the external sleeve 10, and then the base seat 30 is mounted on the bottom surface of the external sleeve 10, the heat shield 80 is positioned in the groove formed between the base seat 3 and the external sleeve 10.

When user smokes via the mouth piece, the atomizer works, air flow flows into the atomizer via the air intake hole 103 of the upper end of the external sleeve 10, the air flow is guided into the lower end of the tobacco holder 41 via the intake channel of the internal sleeve 43. The air flow enters into the atomizing tube 418 and rises up along the atomizing tube 418, and carries out the flue-cured aerosol in the atomizing tube 418. During the process, the air flow is heated by the heating member 42 when the air flow flows through the intake channel, the cooling air is turned to hot air by a heat exchange when the cooling air reaches the tobacco holder. A cooling effect to the evaporation process of the tobacco liquid in the tobacco holder is decreased, the aerosol evaporated by the tobacco liquid is driven by the hot air to flow out of the tobacco holder, for user's swallow, obtaining a better flavor. In the present disclosure, the intake channel is designed to around the heating member, and the intake channel is designed outside the heating member, both sides of the heating member can be employed to heat, when the air flows into the intake channel, it is heated and is turned to hot air in the tobacco holder, thus an effect to the evaporation of the tobacco liquid in the tobacco holder by the cooling air is reduced. Further, the heat shield 80 is sleeved on the periphery of the external sleeve 10 and can effectively isolate the housing of the electronic cigarette from the heating member, providing a better heat isolating effect. The entire air intake passage structure of the tobacco holder is simple. Further, the intake channel is designed to have a spiral structure, a heat efficiency can be effectively enhanced.

It can be understood that, the atomizing tube 418 can define a groove for sleeving the heating member 42, and a limiting gasket 417 fixing the heating member 42 can be eliminated.

The present disclosure relates an atomizer, by positioning the heating member between the atomizing chamber and the internal sleeve having an intake channel, causing the heating member to heat the atomizing chamber, and it can heat the internal sleeve for intaking air flow at the same time. Therefore, it has a simple structure, and a bilaterally heating effect of the heating member can be fully taken advantage. It has a high heating efficiency. When the air flows into the intake channel to be pre-heated, it is turned into hot air when reaches the tobacco holder, thus an effect to the evaporation of the tobacco liquid by the cooling air in the atomizing chamber of the tobacco holder is reduced.

The above are several embodiments of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. An atomizer, comprising:

an external sleeve defining an air intake hole; and a heating assembly received in the external sleeve, wherein the heating assembly comprises:

a tobacco holder defining an atomizing chamber for filling fuming material, the tobacco holder defining a ventilation hole which fluidly communicates with the atomizing chamber, and a heating member for heating the tobacco holder;

wherein a spiral-shaped air intake passage is formed outside the tobacco holder and wound around the tobacco holder, both the air intake hole and the ventilation hole fluidly communicate with the air intake passage, the tobacco holder and/or the heating member configured to heat the air intake passage, wherein the heating assembly further comprises an internal sleeve sleeved over the tobacco holder, the internal sleeve is provided with a helical flange on an external peripheral surface thereof, and a side of the helical flange away from the external peripheral surface of the internal sleeve resists an internal peripheral surface of the external sleeve, or the external sleeve is provided with a helical flange on an internal peripheral surface thereof, and a side of the helical flange away from the internal peripheral surface of the external sleeve resists the external peripheral surface of the internal sleeve, the air intake passage is constituted by a space formed by the helical flange, the internal peripheral surface of the external sleeve, and the external peripheral surface of the internal sleeve, wherein a lower end of the external peripheral surface of the internal sleeve defines an air intake cutout, the air intake passage extends to the lower end of the internal sleeve, and the air intake passage is in fluid communication with an internal chamber of the internal sleeve via the air intake cutout, and wherein the tobacco holder comprises an atomizing tube and forms an end cover at an end of the atomizing tube, the end cover forms external threads at an external peripheral surface thereof, the external sleeve comprises a tubular circumferential wall, the tubular circumferential wall forms an external peripheral flange extending outwardly at an upper end of the tubular circumferential wall, the external peripheral flange is adjacent to a terminal of the upper end of the tubular circumferential wall, an annular section is formed between the terminal of the upper end of the tubular circumferential wall and the external peripheral flange, the annular section defines at least one air intake hole at a circumferential wall of the annular section, an internal peripheral surface of the annular section forms internal threads engaging with the external threads on a periphery of the end cover.

2. The atomizer according to claim 1, wherein the tobacco holder is further provided with a helical flange on an external peripheral surface thereof, and a side of the helical flange away from the external peripheral surface of the tobacco holder resists an internal peripheral surface of the external sleeve, or the external sleeve is provided with a helical flange on an internal peripheral surface thereof, and a side of the helical flange away from the internal peripheral surface of the external sleeve resists the external peripheral surface of the tobacco holder, the air intake passage is constituted by a space which is formed by the helical flange, the internal peripheral surface of the external sleeve, and the external peripheral surface of the tobacco holder.

3. The atomizer according to the claim 2, wherein the heating member is positioned on the external peripheral surface of the tobacco holder, or the heating member is positioned in a sidewall of the tobacco holder, or the heating member is positioned on the internal peripheral surface of the tobacco holder.

4. The atomizer according to the claim 1, wherein the heating member is clamped between the tobacco holder and the internal sleeve, or the heating member is positioned in a sidewall of the tobacco holder, or the heating member is positioned on the internal peripheral surface of the tobacco holder.

5. The atomizer according to claim 1, wherein the external sleeve forms a resisting portion at a lower end thereof shrinking inwardly, the resisting portion is provided at least one cutout, a lower end of the tobacco holder resists the resisting portion, the cutout fluidly communicates with the air intake passage and the ventilation hole respectively.

6. The atomizer according to claim 1, further comprising a base seat positioned on a lower end of the external sleeve, wherein the base seat forms at least two supporting portions at a bottom thereof, the at least two supporting portions extend upwardly, every two adjacent supporting portions forms a cutout there-between, a lower end of the tobacco holder resists the supporting portions, the cutout fluidly communicates with the air intake passage and the ventilation hole respectively.

7. The atomizer according to claim 6, wherein the external sleeve defines two latching grooves opposite to each other at a sidewall of a lower end of the external sleeve, the external peripheral surface of the base seat forms two latch members engaging the two latching grooves, the two latching members extend outwardly along a radial direction of the base seat, a connection between the base seat and the external sleeve is achieved by latching the latching members to the latching grooves.

8. The atomizer according to claim 1, further comprising a base seat, wherein the external sleeve comprises a tubular bottom wall formed on a lower end of the tubular circumferential wall, the tubular bottom wall is provided with a positioning tube at bottom surface thereof, the base seat comprises a bottom plate, the bottom plate defines an aligning hole for the positioning tube to insert there-in when the external sleeve is assembled to the base seat.

9. The atomizer according to claim 8, wherein the heating member comprises a tubular sleeve and a conductive pin connected to an end of the tubular sleeve, the tubular sleeve is sleeved on the atomizing tube, the conductive pin of the heating member extends out of the positioning tube.

10. The atomizer according to claim 1, wherein the tobacco holder is made of a ceramic material.

11. The atomizer according to claim 1, further comprising a heat shield sleeved over the external sleeve.

12. An electronic cigarette, comprising an atomizer according to claim 1.

* * * * *